US005518301A

United States Patent [19]

Boucherie

[11] Patent Number: 5,518,301

[45] Date of Patent: May 21, 1996

[54] METHOD AND DEVICE FOR SUPPLYING FIBRES TO A FILLING TOOL IN A BRUSH MANUFACTURING MACHINE

[75] Inventor: Leonel P. Boucherie, Izegem, Belgium

[73] Assignee: Firma G.B. Boucherie, Belgium

[21] Appl. No.: 436,009

[22] Filed: May 5, 1995

[30] Foreign Application Priority Data

May 9, 1994 [BE] Belgium ..... 09400477

[51] Int. Cl.[6] ..... A46D 1/04; A46D 1/08

[52] U.S. Cl. ..... 300/21; 300/7; 300/9

[58] Field of Search ..... 300/4, 5, 7, 8, 300/9, 10, 11, 21

[56] References Cited

U.S. PATENT DOCUMENTS

| | | | |
|---|---|---|---|
| 3,059,972 | 10/1962 | Schmidt | 300/5 |
| 3,450,312 | 6/1969 | Boucherie | 300/5 |
| 4,111,491 | 9/1978 | Steinebrunner et al. | 300/21 |
| 4,360,236 | 11/1982 | Boucherie | 300/9 |
| 4,430,039 | 2/1984 | Boucherie | 414/417 |
| 4,733,917 | 3/1988 | Boucherie | 300/7 |

FOREIGN PATENT DOCUMENTS

| | | |
|---|---|---|
| 0304110A1 | 2/1989 | European Pat. Off. . |
| 0346965A2 | 12/1989 | European Pat. Off. . |
| 0433470A1 | 6/1991 | European Pat. Off. . |
| 4040297A1 | 6/1992 | Germany . |

*Primary Examiner*—John Husar
*Attorney, Agent, or Firm*—Bacon & Thomas

[57] ABSTRACT

A method for supplying fibres to a filling tool in brush manufacturing machines, includes, per operating cycle, taking a bundle of fibres (7) from a selected fibre supply duct (4,5) to the filling tool (3) by means of a bundle take-up device (6) which cooperates with at least two fibre ducts (4,5), and using, for the selective supply of the fibres (2–2A), moveable closing devices (19,20) which cooperate with the supply ends (11,12) of the fibre ducts (4,5) and which ensure, by their movement that fibres (2–2A) can only be taken from one fibre duct (4,5) at a time by the bundle take-up device. The closing devices (19,20) are mounted on a common support for simultaneous movement each cycle.

19 Claims, 2 Drawing Sheets

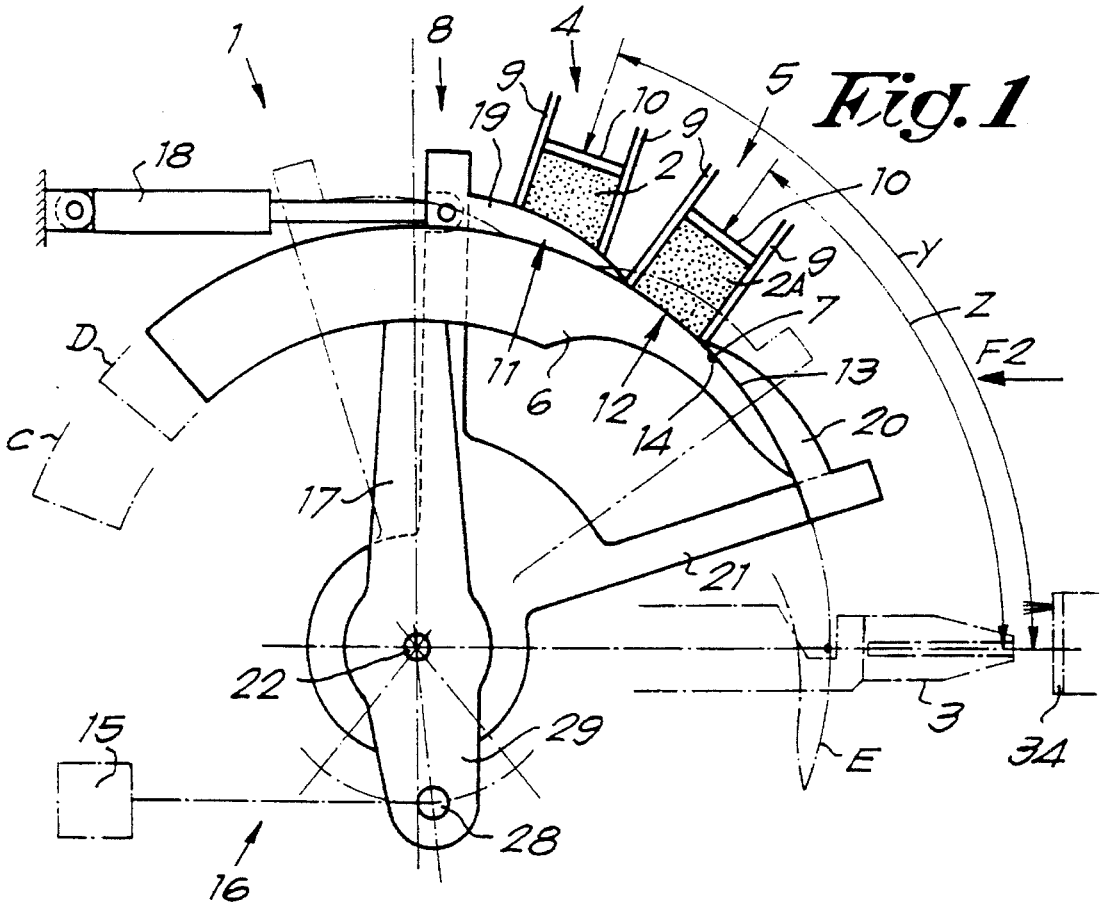
Fig. 1
Fig. 2
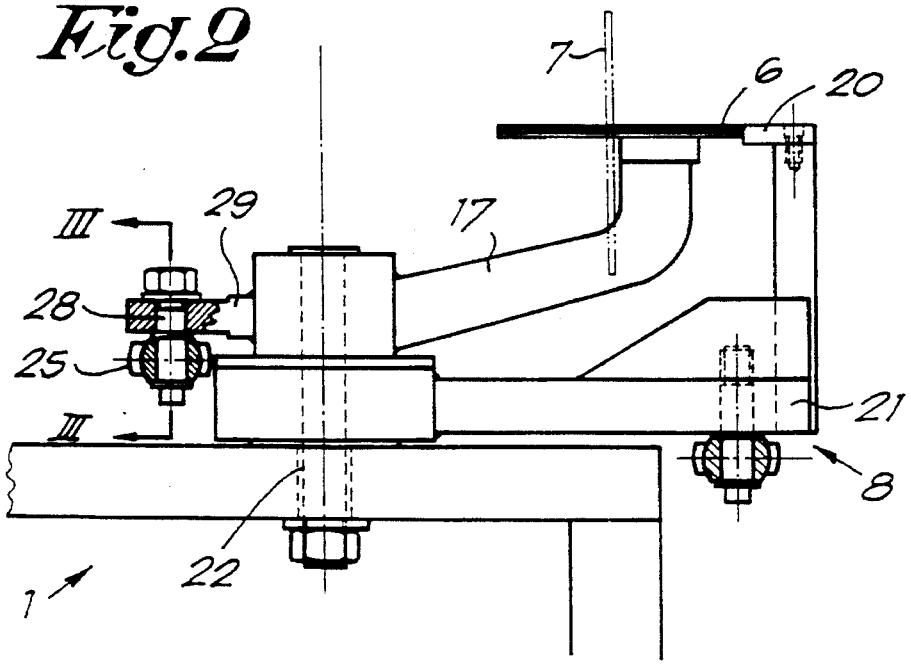

METHOD AND DEVICE FOR SUPPLYING FIBRES TO A FILLING TOOL IN A BRUSH MANUFACTURING MACHINE

The present invention concerns a method and device for supplying fibres to a filling tool in a brush manufacturing machine.

In particular, the invention concerns brush manufacturing machines of the type whereby, by means of a bundle take-up device which cooperates with at least two fibre ducts, a bundle of fibres is taken from a selected fibre duct to a filling tool each operating cycle.

The known brush manufacturing machines of this type, as well as the methods applied herein, are disadvantageous in that they are quite complex.

In known brush manufacturing machines, the fibre ducts must carry out complicated movements, and the fibre ducts are relatively unwieldy, so that the speed of such a device is restricted.

Thus the invention intends to provide a method and device for supplying fibres to a filling tool which do not have said disadvantages.

SUMMARY OF THE INVENTION

The invention comprises a method for supplying fibres to a filling tool in brush manufacturing machines, whereby, per operating cycle, a bundle of fibres supply is taken from a selected fibre duct by means of a fibre bundle take-up device that cooperates with at least two fibre supply ducts and is supplied to the filling tool. The selective supply of the fibres is carried out using moveable closing devices which cooperate with the supply ends of fibre supply to ensure ducts that fibres can only be taken from one fibre supply duct at a time.

According to a preferred embodiment, two fibre supply ducts are used with closing devices which are connected to one another in such a way that, if one is open, the other is closed, and vice versa.

According to a special embodiment of the invention, the course of the bundle take-up device is changed during the operation. Thus, the course of the bundle take-up device is preferably directed as a function of the fibre duct from which the fibres must be taken, which offers the advantage that the bundle take-up device does not need to follow an entire course during each operating cycle, as the course can be restricted up to the fibre duct from which fibres are to be taken.

The invention also concerns an apparatus to carry out the above-mentioned method, the apparatus comprising at least two fibre supply ducts, a fibre bundle take-up device which cooperates with these fibre ducts and which, per operating cycle, brings a bundle of fibres supply from a selected fibre duct to the filling tool and blocking means to ensure that, per operating cycle, fibres can be taken from only one fibre duct, such means comprising movable closing devices which cooperate with the supply ends of the fibre ducts and which can be moved by means of drive.

The invention also concerns a device for supplying fibres to a filling tool in a brush manufacturing machine, the machine comprising at least two fibre ducts, a fibre bundle take-up device cooperating with these fibre ducts and which, per operating cycle, brings a bundle of fibres from a selected fibre duct to the filling tool blocking means for ensuring that, per operating cycle, fibres can be taken from only one fibre duct, at a time to change the course of the bundle take-up device, and a stroke control means which changes the travel of the bundle take-up device as a function of the fibre duct from which the fibres are to be taken, such that, at each take-up, the bundle take-up device is merely moved to the fibre duct from which fibres are to be taken for the cycle concerned.

BRIEF DESCRIPTION OF THE DRAWINGS

In order to better explain the characteristics of the invention, the following preferred embodiment is described as an example only without being limitative in any way, with reference to the accompanying drawings, in which:

FIG. 1 is a schematic top view of a device according to the invention;

FIG. 2 shows a view taken along arrow F2 in FIG. 1, but with more detail

DETAILED DESCRIPTION

Figure 3:
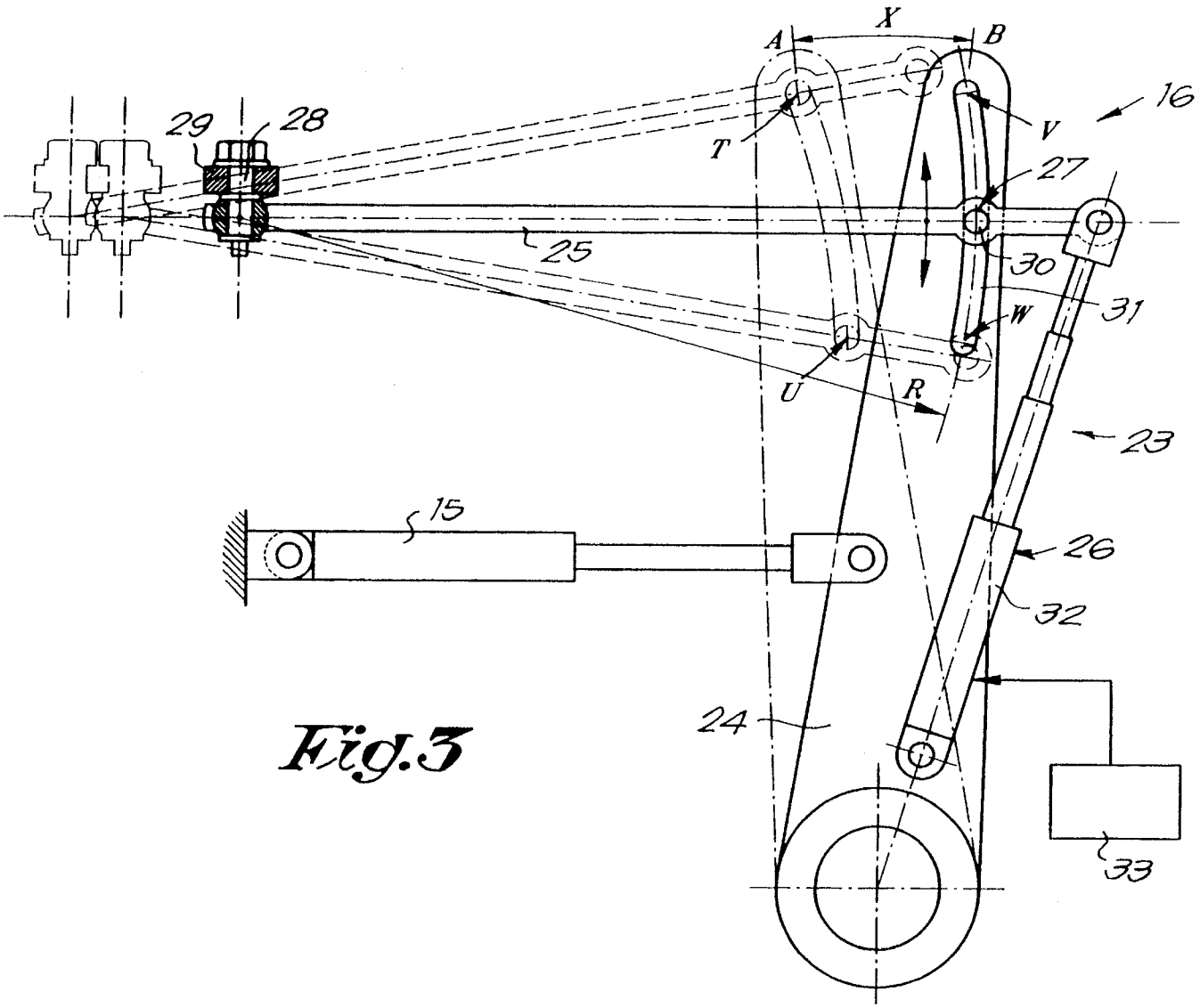
FIG. 3 is a schematic section taken along line III—III in FIG. 2, but to another position.

As shown in the FIGS. 1 and 2, the invention comprises apparatus 1 for supplying fibres 2–2A to a filling tool 3 in a brush manufacturing machine. The apparatus includes at least two fibre fibre ducts 4 and 5, a fibre bundle take-up device 6 which cooperates with said two fibre ducts 4 and 5 and which, per operating cycle, can bring a bundle of fibres 7 from a selected fibre duct, 4 or 5 respectively, to the filling tool 3, and a blocking means 8 which ensures that per operating cycle, fibres 2–2A can be taken from only one fibre duct 4 or 5 at one time.

The fibre ducts 4 and 5 comprise, as is known, guides 9 in between which an amount of fibres 2–2A is provided which, by means of follower elements 10, can be pressed in the direction of the bundle take-up device 6. The bundle take-up device 6 consists, as is known, of an element, usually in the shape of a half moon, which can be rotated between the supply ends 11 and 12 of the fibre ducts 4 and 5 and the filling tool 3. The element 6 has a recess 14 at its edge 13, in which, per operating cycle, a bundle of fibres 7 can be taken up and separated from the fibres 2–2A in the fibre duct 4 or 5. The bundle take-up device 6 is rotated by means of a drive element 15 and coupling means 16 provided between the drive element 15 and the bundle take-up device 6, the coupling means also including among others the lever 17 represented in the FIGS. 1 and 2.

According to the invention, the above-mentioned blocking means 8 consist of blocking or closing devices 19 and 20 which cooperate with the supply ends 11 and 12 of the fibre ducts 4 and 5 and which can be moved simultaneously by means of a drive 18 to ensure that fibres 2—2A can be taken from only one fibre duct 4 or 5 at the time.

In the case where the device 1, as represented in FIG. 1, has two fibre supply ducts 4 and 5, two closing devices 19 and 20 preferably should be used which are connected rigidly together such that, if one is open, the other is closed, and vice versa. To this end, these closing devices 19 and 20 are fixed on one common support 21 that can preferably be rotated around the shaft 22 of the lever 17.

The closing devices 19 and 20 preferably consist of wedge-shaped pieces, such that the fibres 2—2A can be easily pushed back over a short distance when the fibre duct 4 or 5 is closed off and the wedge-shaped pieces can be placed before the fibres 2—2A.

It will also be observed from FIG. 1 that the rear sides of closing devices 19 and 20 serve as guides to prevent release of fibre bundle 7 from recess 14 in bundle take-up device 6 over at least a portion of the movement of the take-up device.

The device 1 according to the invention also contains stroke control means 23 to change the travel of the bundle take-up device 6.

As shown in FIG. 3, the stroke control means 23 may be part of the coupling means 16 and may consist of a crank element 24 which is moved back and forth between two fixed positions A and B by means of a crank drive element 15; a connection including lever 17 and coupling bar 25 which couples the bundle take-up device 6 to the above-mentioned element 24 and a stroke control or variable throw mechanism 23 including a drive mechanism 26 which makes it possible to shift the coupling point 27 between said connection and the above-mentioned element 24, such that at least in one position of the element 24, in this case the position A, by shifting the coupling point 27, the bundle take-up device 6 can take up at least two positions C and D.

As represented in the FIGS. 2 and 3, a coupling bar or drive rod 25 is preferably connected to the end 29 of the lever 17 by means of a universal joint 28.

The crank element 24 in this embodiment to comprises an arm or crank which can be rotated over an angle X. The coupling point 27 consists of a pivot 30 which can be shifted in a groove 31, provided in the crank 24.

The groove 31 preferably extends along an arc. such that the hinge point 28 in position B of the element 24 remains in the same place for all positions of the coupling point 27. This is made possible by making use of a groove 31 which, in position B of the element 24, extends along an arc centered at the hinge point of the universal joint 28, with a radius R as represented in FIG. 3.

The pivot 30 is moved by means of a pressure cylinder 32 of drive mechanism 26, and which can preferably take up two positions, such that the coupling point 27 is situated at one or the other end of the groove 31, respectively.

The stroke control mechanism 23 preferably includes a control 33 which changes the travel of bundle take-up device 6 as a function of the fibre duct 4 or 5 from which fibres 2—2A are to be taken, such that the bundle take-up device 6 is only moved by crank drive 15 to the fibre duct 4 or 5 to be used at each take-up, in other words such that no unnecessary movement of take-up device 6 is made.

The operation of the apparatus 1 can be easily observed from the drawing and above description. In the case where, as represented in FIG. 1, the blocking device 19 is placed before the fibre duct 4, only fibres 2A can be taken from the fibre duct 5. By moving the blocking devices 19 and 20 into the position represented by means of the dot and dash line, only fibres 2 can be taken from the fibre duct 4.

Thus, via the control of the drive 18, it is possible to choose to take fibres 2 from the fibre duct 4 or fibres 2A from the fibre duct 5. It is the intention that two sorts of fibres are hereby provided in the fibre ducts 4 and 5, either fibres of different nature, of different size or of different colour, which are then provided in a brush body 34 according to a preset pattern.

According to the preferred embodiment of the invention, the rotation of the bundle take-up device 6 is restricted so that rotation only occurs up to the fibre duct 4 or 5 from which fibres 2—2A are to be taken at that time.

This is achieved, in the case where fibres 2 are to be taken from the fibre duct 4, by placing the coupling point 27 at the position A of the element 24 in point T, and in the case where fibres 2A are to be taken from the fibre duct 5, by placing the coupling point 27 in position A of the element 24 at point U, as indicated in FIG. 3.

When the element 24 is in position B, it is in theory not important where the coupling point 27 is situated in the groove 31, since the place of the coupling point 27 in this case has no influence on the place of the universal joint 28. Thus the bundle take-up device 6 is then always in the position E, with the recess 14 centrally in front of the filling tool 3.

In the case where fibres 2 are to be taken from the duct 4 several times in a row, the coupling point 27 will be maintained in the highest position, with the pressure cylinder 32 maintain in extended position. The coupling point 27 then moves back and forth between the points T and V in FIG. 3. If fibres 2A are required several times in a row, the pressure cylinder 32 can remain retracted, whereby the coupling point 27 will then move between the points U and W.

It is clear that the movement of the coupling point 27 along the groove 31 can be realised during the rotation of the element 24 between the positions A and B.

Depending on whether the coupling point 27 is situated in the point T or U, the bundle take-up device 6 will move between the positions E and C or the positions E and D, as indicated in FIG. 1. The rotations realized hereby are Y and Z respectively.

It should be noted that the invention also contemplates a method and device whereby the above-described stroke control means 23 are combined with other blocking means 8 than those which consist of the above-described closing devices 19 and 20.

The movement of the bundle take-up device 6, as well as the required travel thereof, can also be realized by means of an electronically programmable control and, for example, a servomotor. This also applies to the different elements of the filling tool 3, such as the slide, the needle which each time anchors the bundles of fibres 7 in the opening concerned of the brush body 34, the feeding in steps of the thread and the cut and profile elements for the clamp or the anchor with which each little bundle of fibres 7 is fixed in the brush body 34. By properly programming the different drive systems of the elements for supplying the bundles of fibres 7 and for inserting and anchoring them in the brush body 34, their movements and positions can be perfectly synchronized in the required manner.

The present invention which is set forth in the following claims is by no means limited to the embodiment described as an example and represented in the accompanying drawings; on the contrary, such a method and device for supplying fibres to a filling tool in a brush manufacturing machine can be made in all sorts of variants while still remaining within the scope of the invention.

I claim:

1. A method for cyclically supplying fibres to a filling tool in a brush manufacturing machine including at least two fibre supply ducts having supply ends for supplying bundles of fibres to a fibre bundle take-up device that cyclically transports the fibre bundles to a brush body filling tool comprising, for each machine operating cycle;

transporting a bundle of fibres taken from a selected one of the at least two fibre supply ducts to the filling tool by means of the bundle take-up device that cooperates with the fibre supply ducts; and cyclically opening and closing the fibre supply ducts by blocking devices interconnected in fixed relationship with respect to each other mounted on a unitary movable support during movement of the fibre bundle take-up device, whereby the other of the fibre supply ducts not supplying fibres to the fibre bundle take-up is closed off while the fibres are supplied from the selected one fibre supply duct to the bundle take-up device.

2. The method according to claim 1, including using solely two fibre supply ducts and two blocking devices which are interconnected such that one fibre supply duct is open while the other is blocked by a blocking device, and vice versa.

3. The method according to claim 1, wherein the fibre supply ducts are located at spaced points along a path of travel of the bundle take-up device, and controlling the travel path of the bundle take-up device so that the take-up device only travels to a respective fibre supply duct from which fibres are to be taken during each operating cycle and not to a further fibre supply duct.

4. A method according to claim 3, wherein the bundle take-up device comprises a rotatable element having an edge including a recess therein for receiving the bundle of fibres to be taken-up from the fibre supply ducts, and including the step of rotating the bundle take-up device in a first direction to present the recess to the filling tool and in a second opposite direction to present the recess to the supply end of a fibre supply duct from which fibres are to be taken.

5. A method for supplying fibres to a filling tool in brush manufacturing machines, comprising, for each operating cycle, transporting a bundle of fibres from a selected one of a pair of fibre supply ducts to a filling tool by means of a bundle take-up device that moves along a path of travel between a filling tool and a pair of fibre supply ducts located at spaced points along the path of travel of the bundle take-up device, said bundle take-up device including a fibre bundle receiving recess, and varying the travel distance of the bundle take-up device as a function of the location of the fibre supply duct from which the fibres are to be supplied, said recess being moved during each take-up of fibres so as to only travel to the respective fibre supply ducts and not to a further fibre supply duct than the fibre supply duct from which the fibres are to be taken.

6. Apparatus for cyclically supplying fibres to a brush body filling tool in a brush manufacturing machine comprising:

at least two fibre supply ducts;

a movable fibre bundle take-up device arranged to move along a path of travel between a filling tool and one or the other of the at least two fibre supply ducts to receive a bundle of fibres from said one or other fibre supply duct each cycle of operation of the machine; and a blocking means associated with each supply duct for blocking the fibre supply duct not supplying fibres to said bundle take-up device while the bundle take-up device is receiving fibres from another fibre supply duct;

said blocking means being mounted in fixed relationship with each other on a common movable support for simultaneous movement with the support; and means for cyclically moving the movable support to actuate the blocking means.

7. Apparatus according to claim 6, including means for varying the travel distance of said bundle take-up device along its path of travel between said filling tool and said fibre supply ducts.

8. Apparatus according to claim 7, wherein said means for varying the travel distance of the bundle take-up device includes a travel control for varying the travel of the bundle take-up device as a function of the distance required to reach a respective fibre supply duct from which a fibre bundle is to be taken, whereby, during each fibre bundle take-up operation, the bundle take-up device is moved only to the respective fibre duct from which fibres are to be taken, said ducts being located at different points along the path of travel of said fibre take-up device.

9. Apparatus according to claim 8, including:

a bundle take-up device drive member cyclically movable between two end positions;

a drive means for selectively driving the drive member to a respective one of its end positions;

a coupling arrangement for connecting the drive member to the bundle take-up device, said coupling arrangement including a variable throw device that is adjustable to vary the distance traversed by the bundle take-up device in response to travel of the drive member to a respective end position.

10. Apparatus according to claim 9, wherein the variable throw device is adjustable to vary the travel of the bundle take-up device between different bundle take-up device end positions.

11. Apparatus according to claim 10, wherein said coupling arrangement includes means for causing one end position of travel of the bundle take-up device to remain at a constant location each machine operating cycle irrespective of any adjustment of the variable throw device.

12. Apparatus according to claim 10, wherein:

said drive member is a rotatable crank arm pivotable about an axis of rotation;

said drive member is a reciprocating drive rod connecting the crank arm to the bundle take-up device, whereby pivotal motion of the crank arm is transmitted to the bundle take-up device by the drive rod to cause the bundle take-up device to travel over a path of travel between the filling tool and the fibre supply ducts each machine operating cycle; and said variable throw device comprising stroke varying means for varying the distance between the crank arm axis of rotation and the point of connection of the drive rod to the crank arm to thereby vary the output motion of the crank arm in response to crank arm rotation.

13. Apparatus according to claim 12, wherein:

the drive rod is connected to the bundle take-up device at a pivotal connection, said crank arm including an arcuate groove having a circular arc of curvature centered at said pivotal connection; and said drive rod being connected to said crank arm by a pivot element slidable along said groove by said stroke varying means.

14. Apparatus according to claim 13, wherein said stroke varying means comprises a variable length fluid activated actuator.

15. Apparatus according to claim 12, wherein said bundle take-up device includes a fibre bundle receiving recess for receiving fibres from a respective fibre supply duct and is rotatable over a path of travel that moves the recess between a respective fibre supply duct and the filling tool;

a lever connected to the bundle take-up device for driving same in rotation about a bundle take-up device axis of rotation; and said drive rod connected to said lever by a universal joint connection.

16. Apparatus according to claim 6, whereby said blocking means form guides co-operating with the bundle take-up device, said guides preventing a fibre bundle taken up in the bundle take-up device to be released from said device during at least part of the movement of said take-up device.

17. Apparatus according to claim 6 including two fibre supply ducts and wherein said blocking means consists of two wedge shaped blocking devices; said blocking devices being movable to a blocking position from opposite sides of each supply duct and in such blocking position being located between the bundle take-up device and a respective fibre supply duct.

18. Apparatus for cyclically supplying fibres to a brush body filling tool in a brush manufacturing machine comprising:

at least two fibre supply ducts;

a fibre bundle take-up device movable along a path of travel extending between a filling tool and said fibre supply ducts;

said fibre supply ducts located at spaced points along the path of travel of said bundle take-up device;

said bundle take-up device arranged to approach one or the other of the at least two fibre supply ducts to receive a bundle of fibres from said one or other fibre duct each cycle of operation of the machine; and means for controlling the travel distance of said bundle take-up device such that the take-up device only traverses a distance extending from the filling tool to the one fibre supply duct from which it is to receive fibres each operating cycle of the machine.

19. Apparatus according to claim 18, including blocking means for blocking the fibre supply duct not supplying fibres to said bundle take-up device each machine operating cycle while the bundle take-up device is receiving fibres from a supplying fibre supply duct.

* * * * *